US010040658B2

(12) United States Patent
Maeda

(10) Patent No.: US 10,040,658 B2
(45) Date of Patent: Aug. 7, 2018

(54) PRINTING APPARATUS

(71) Applicant: SEIKO EPSON CORPORATION, Tokyo (JP)

(72) Inventor: Hiroyuki Maeda, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/459,429

(22) Filed: Mar. 15, 2017

(65) Prior Publication Data

US 2017/0282603 A1 Oct. 5, 2017

(30) Foreign Application Priority Data

Apr. 4, 2016 (JP) ..... 2016-075304

(51) Int. Cl.

| | |
|---|---|
| ***B65H 9/00*** | (2006.01) |
| ***B41J 13/00*** | (2006.01) |
| ***B41J 13/26*** | (2006.01) |
| ***B41J 11/42*** | (2006.01) |
| ***B41J 11/00*** | (2006.01) |
| ***B41J 3/60*** | (2006.01) |

(52) U.S. Cl.

CPC ..... *B65H 9/006* (2013.01); *B41J 3/60* (2013.01); *B41J 11/0035* (2013.01); *B41J 11/42* (2013.01); *B41J 13/0009* (2013.01); *B41J 13/0018* (2013.01); *B41J 13/26* (2013.01); *B65H 9/004* (2013.01)

(58) Field of Classification Search

CPC ..... B41J 3/60; B65H 9/006

See application file for complete search history.

(56) References Cited

U.S. PATENT DOCUMENTS

2014/0240428 A1* 8/2014 Norikane ..... B41J 11/0055 347/104

FOREIGN PATENT DOCUMENTS

JP 57092347 A * 6/1982 ..... B65H 9/00
JP 2011-037561 A 2/2011

OTHER PUBLICATIONS

Machine generated English translation of JP57-092347A to Shimada, "Registration Device"; retrieved via http://translationportal.epo.org/emtp/translate/?ACTION=description-retrieval&COUNTRY=JP&Engine=google&FORMAT=docdb&KIND=A&LOCALE=en_EP&NUMBER=S5792347&OPS=ops.epo.org/3.2&SRCLANG=ja&TRGLANG=en on Oct. 23, 2017; 3pp.*

* cited by examiner

*Primary Examiner* — Shelby Fidler

(57) ABSTRACT

A printing apparatus includes a print section configured to perform printing on a first side of a medium and then perform printing on a second side that is a back side of the first side, a supply path configured to supply the medium toward the print section, a feeding roller configured to feed the medium along the supply path from an upstream side to a downstream side in a transport direction, a toothed roller provided on the downstream side of the feeding rollers in the transport direction, a drive source configured to rotate the feeding roller and the toothed roller, and a controller configured to control driving of the drive source. The controller performs rotation control for rotating the feed rollers prior to the rotation of the toothed roller with which the medium has collided.

7 Claims, 8 Drawing Sheets

PRINTING APPARATUS

BACKGROUND

1. Technical Field

The present invention relates to a printing apparatus for performing printing on a medium.

2. Related Art

An image forming apparatus, which is an example printing apparatus, including a transfer unit (printing unit) for transferring a toner image onto a sheet of paper, which is an example medium, is known (see, for example, JP-A-2011-37561). In such an image forming apparatus, a paper sheet transported by a feeding transport roller is made to collide with a registration roller that has been stopped such that the transport of the paper sheet is temporarily stopped.

Meanwhile, the rotation speeds of the rollers and the timing to start the rotation vary from apparatus to apparatus. Due to such variations, when a stopped registration roller is driven, the registration roller may slip against a paper sheet.

In another case, for example, in a printing apparatus that performs printing on both sides by applying liquid onto a paper sheet, after printing is performed on one side, the paper sheet is transported by a registration roller. However, when the registration roller slips against the paper sheet, the sheet is damaged.

Such a problem is common not only among the image forming apparatuses that transfer a toner image onto a paper sheet but also among printing apparatuses that perform printing onto a medium.

SUMMARY

An advantage of some aspects of the invention is that there is provided a printing apparatus capable of reducing damage to a medium.

Hereinafter, an apparatus for solving the above-mentioned problem and its operational advantages will be described. A printing apparatus that solves the above-described problem includes a print section configured to perform printing on a first side of a medium and then perform printing on a second side that is a back side of the first side, a supply path configured to supply the medium toward the print section, a feeding roller configured to feed the medium along the supply path from an upstream side to a downstream side in a transport direction, a toothed roller provided on the downstream side of the feeding rollers in the transport direction, a drive source configured to rotate the feeding rollers and the toothed roller, and a controller configured to control driving of the drive source. The controller performs rotation control for rotating the feed roller prior to the rotation of the toothed roller with which the medium has collided.

Rotating the toothed roller may cause slip against the medium and damage the medium. To address the problem, the rotation control for rotating the feeding roller is performed prior to the rotation of the toothed roller, and the toothed roller can be prevented from slipping against the medium accordingly. As a result, damage to the medium can be reduced compared with a case where the rotation control is not performed.

In this printing apparatus, it is preferable that the controller perform the rotation control if the grammage of the medium is greater than or equal to a threshold value.

A medium that has a large grammage is firm and less flexible, whereas a medium that has a small grammage is less firm and less flexible. Accordingly, if the rotation control is performed when the medium having the small grammage is fed, the medium may be largely bent and the medium may buckle. With this configuration, if the grammage of the medium is greater than or equal to the threshold value, the controller performs the rotation control, and thereby the medium can be fed while buckling is reduced.

In this printing apparatus, it is preferable that the supply path include a first supply path configured to supply the medium from a first supply section toward the print section, and a second supply path configured to supply the medium from a second supply section toward the print section, the second supply path being curved more than the first supply path, and the controller perform the rotation control when the medium is supplied from the first supply section along the first supply path.

A medium that is supplied along the second supply path is provided while bending to fit the curve of the second supply path. Consequently, for a less flexible medium, the first supply path, which is straighter than the second supply path, is supplied. With this configuration, when the controller supplies the first supply path for the medium, the controller performs the rotation control, and thereby damage to the less flexible the medium can be reduced.

In this printing apparatus, it is preferable that the controller continue to rotate the feeding roller after the medium has collided with the toothed roller in the rotation control.

With this configuration, the feeding rollers continue to rotate after the medium has collided with the toothed roller. This rotation causes the medium to bend, which enables the medium to correct its skewing. Accordingly, for example, even if the medium is supplied in a skewed state, the medium can be corrected and fed.

In this printing apparatus, it is preferable that the printing apparatus further include a switchback mechanism configured to switch back the medium having the first side and the second side on which printing has been performed on the first side and configured to transport the medium to the supply path. Between a first transport operation in which the first side is on the print section side and a second transport operation in which the medium is switched back by the switchback mechanism and the second side is on the print section side, the controller performs the rotation control in the first transport operation.

For example, if the medium is cellulose-based paper, when printing is performed onto the medium with a water-based ink, the ink weakens the hydrogen bonds of the cellulose and the medium becomes more flexible. Consequently, the medium bends more easily in the second transport operation, in which printing has been performed on the front side and the medium is switched back, compared with the medium in the first transport operation, in which printing has not been performed. With this configuration, the rotation control is performed in the first transport operation, in which the medium is less flexible, and thereby damage to the medium can be reduced.

In this printing apparatus, it is preferable that the printing apparatus further include a clutch capable of interrupting the transmission of the driving force from the drive source to the toothed roller.

With this configuration, transmission and interruption of the driving force to the toothed roller can be switched by the clutch, and the feeding roller and the toothed roller can be rotated by one feeding motor.

In this printing apparatus, it is preferable that the drive source include a first drive source configured to rotate the feeding roller and a second drive source configured to rotate the toothed roller.

With this configuration, the controller drives the first drive source to rotate the feeding roller and drives the second drive source to rotate the toothed roller, which enables the controller to readily control the rotation of the feeding rollers and the toothed roller.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a printing apparatus will be described with reference to the attached drawings. The printing apparatus according to the embodiment is a printer that performs printing (recording) by discharging an ink, which is an example liquid, onto a medium such as paper to print (record) characters or an image.

Figure 1:
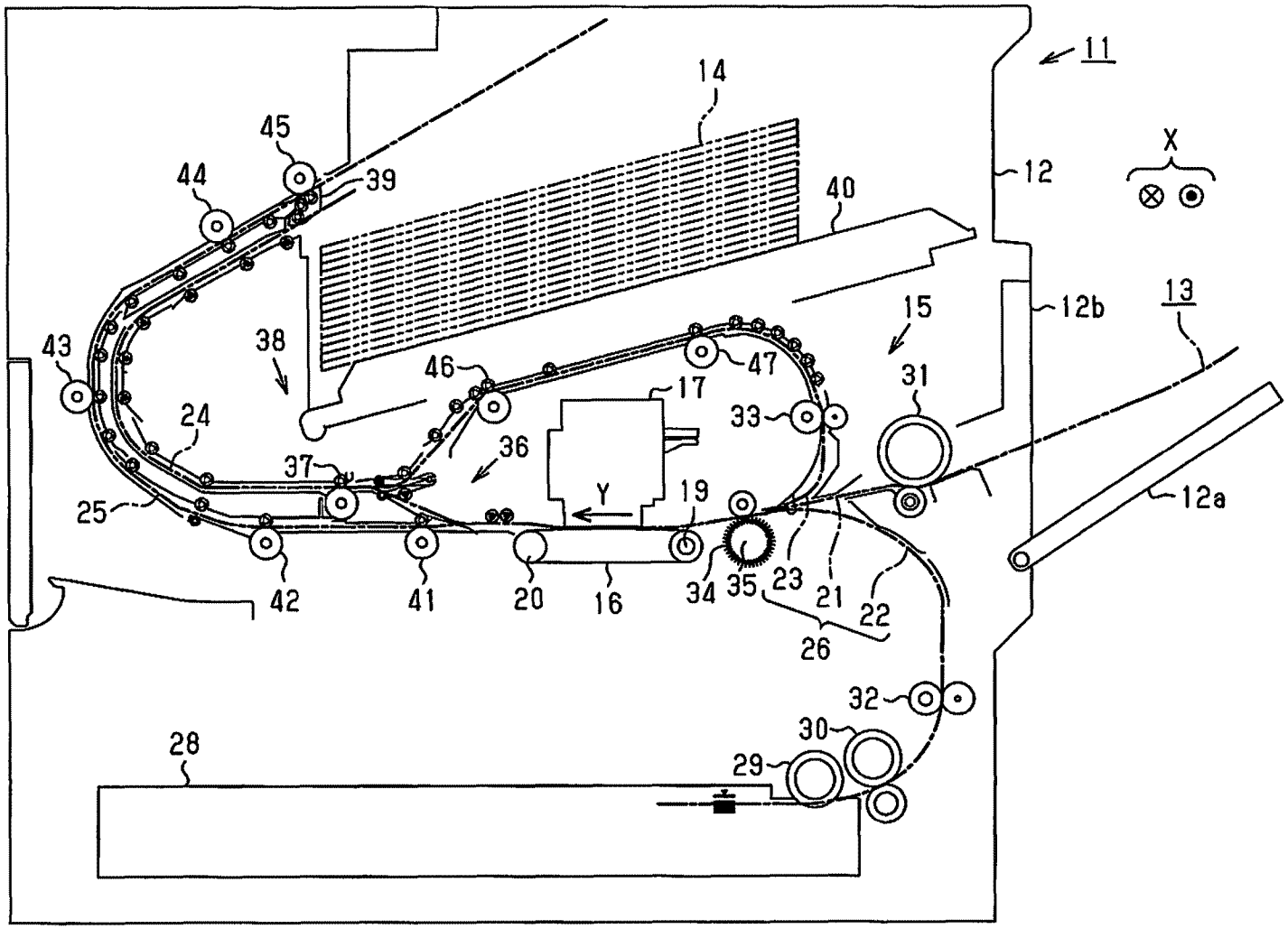
FIG. 1 is a schematic view of a printing apparatus according to an embodiment.

As illustrated in FIG. 1, a printing apparatus 11 according to the embodiment includes a substantially rectangular parallelepiped housing 12 and a transport section 15 that transports a medium 14 along a transport path 13 denoted by the alternate long and short dashed line in FIG. 1. The printing apparatus 11 further includes, along the transport path 13, a transport belt 16 that transports the medium 14 while supporting the medium 14 against gravity and a printing unit 17 that is disposed opposite the transport belt 16 with the transport path 13 therebetween.

The transport belt 16 is an endless belt and is looped around a drive pulley 19, which is driven by a transporting motor 18 (see FIG. 2) to rotate, and a driven pulley 20, which is freely rotatable around a shaft that is parallel to a shaft of the drive pulley 19. The transport belt 16 travels around the pulleys and transports the medium 14, which is supported by electrostatic adsorption on the outer peripheral surface of the transport belt 16. In other words, the outer peripheral surface of the transport belt 16 is a part of the transport path 13.

The printing unit 17 is a line head that can simultaneously discharge a liquid such as an ink in the width direction X of the medium 14. The width direction X intersects (for example, is orthogonal to) a transport direction Y in which the medium 14 is transported. The printing unit 17 performs printing onto the medium 14 by discharging a liquid onto the medium 14 that is transported by the transport belt 16.

The transport path 13 includes a first supply path 21, a second supply path 22, and a third supply path 23, which are on the upstream side of the transport belt 16 in the transport direction Y, and a branch path 24 and a discharge path 25, which are on the downstream side of the transport belt 16 in the transport direction Y. Furthermore, the first supply path 21 to the third supply path 23 form a supply path 26 that supplies the medium 14 toward the printing unit 17. In other words, the supply path 26 includes the first supply path 21, the second supply path 22, and the third supply path 23.

The first supply path 21 connects an insertion slot 12*b*, which is exposed when a cover 12*a* provided on one side surface of the housing 12 is opened, and the transport belt 16. The medium 14 is supplied from the insertion slot 12*b* toward the printing unit 17.

The second supply path 22 connects a medium cassette 28, which is detachably attached to a bottom section on the lower side in the direction of gravity, and the transport belt 16. The medium 14 is supplied from the medium cassette 28 toward the printing unit 17. The second supply path 22 is curved more than the first supply path 21. In the first supply path 21, a pickup roller 29 for feeding the top medium 14 of the media 14 stacked in the medium cassette 28 and a separation roller 30 for separating the media 14 fed by the pickup roller 29 one by one, are provided.

The third supply path 23 is disposed above the printing unit 17 to partially encompass the printing unit 17. The third supply path 23 returns the medium 14 that has passed through the transport belt 16 and the printing unit 17 to the upstream side of the transport belt 16.

In the first supply path 21, a first feeding roller 31 that feeds the medium 14 that has been inserted from the insertion slot 12*b* along the first supply path 21 from the upstream side toward the downstream side in the transport direction Y is provided. In the second supply path 22, on the downstream side of a separation roller 30 in the transport direction Y, a second feeding roller 32 that feeds the medium 14 along the second supply path 22 from the upstream side toward the downstream side in the transport direction Y is provided. In the third supply path 23, a third feeding roller 33 that feeds the medium 14 along the third supply path 23 from the upstream side toward the downstream side in the transport direction Y is provided. In the description below, the first feeding roller 31 to the third feeding roller 33 are also collectively referred to as feeding rollers 31 to 33.

A toothed roller 35 that has a plurality of convex portions 34 on its peripheral surface is provided at a position where the first supply path 21 to the third supply path 23 merge on the downstream side of the feeding rollers 31 to 33 in the transport direction Y.

The feeding rollers 31 to 33 and the toothed roller 35 are provided together with respective driven rollers that follow the corresponding rollers such that the feeding rollers 31 to 33, the toothed roller 35, and the corresponding driven rollers are used in pairs. The feeding rollers 31 to 33 and the toothed roller 35 pinch the medium 14 with the corresponding driving rollers and rotate to transport the medium 14 toward the printing unit 17.

On the downstream side of the transport belt 16 in the transport direction Y, a branching mechanism 36 that is capable of guiding the medium 14 to the branch path 24 is provided. The branching mechanism 36 includes, for example, a flap. The branching mechanism 36 guides the medium 14, which has been guided to the branch path 24, toward the third supply path 23. In the branch path 24, a branch roller pair 37 that is rotatable in both forward and reverse directions is provided. In this embodiment, the branch path 24, the branching mechanism 36, and the branch roller pair 37 serve as a switchback mechanism 38. That is, the switchback mechanism 38 switches back the medium 14, which has a front side 14*a* that is an example first side and a back side 14*b* that is an example second side of the medium 14, on which printing has been performed on the front side 14*a*, to transport the medium 14 toward the third supply path 23 (see FIG. 9).

The discharge path 25 connects a discharge port 39, from which the printed medium 14 is discharged, and the transport belt 16. The medium 14 discharged from the discharge port 39 is placed onto a mounting table 40. In the discharge path 25, at least one transport roller pair is provided. In this embodiment, five transport roller pairs, that is, a first transport roller pair 41 to a fifth transport roller pair 45, are provided. In the third supply path 23, at least one transport roller pair is provided. In this embodiment, two transport roller pairs, that is, a sixth transport roller pair 46 and a seventh transport roller pair 47, are provided.

The transport section 15 according to the embodiment includes the transport belt 16, the drive pulley 19, the driven pulley 20, the pickup roller 29, the feeding rollers 31 to 33, the toothed roller 35, and the first transport roller pair 41 to the seventh transport roller pair 47.

An electrical configuration of the printing apparatus 11 will be described.

Figure 2:
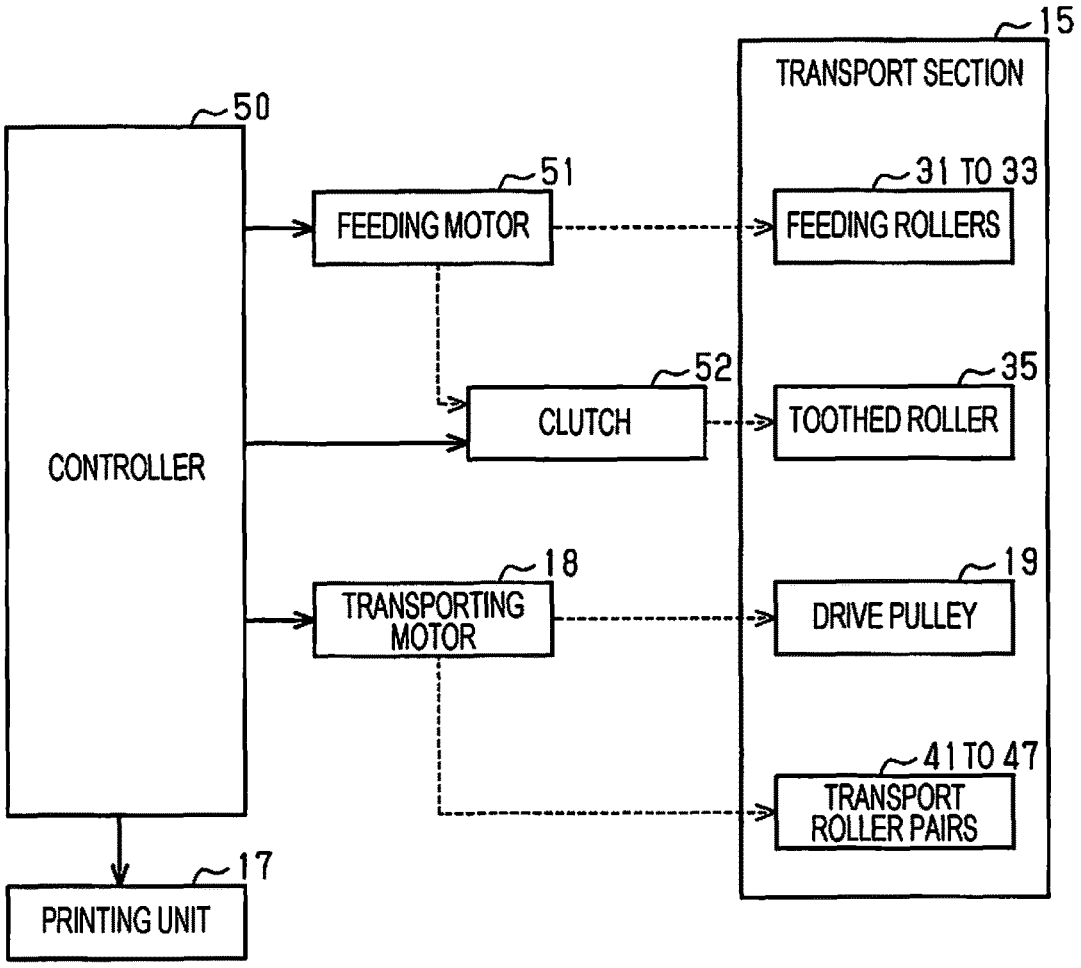
FIG. 2 is a block diagram of a controller.

As illustrated in FIG. 2, the printing apparatus 11 includes a controller 50 that performs overall drive control of the mechanisms in the printing apparatus 11 such as the printing unit 17. The printing apparatus 11 also includes a feeding motor 51, which is an example drive source for rotating the feeding rollers 31 to 33 and the toothed roller 35. The printing apparatus 11 also includes a clutch 52 that can interrupt transmission of the driving force from the feeding motor 51 to the toothed roller 35 indicated by the arrow of the dotted line in FIG. 2. That is, the controller 50 controls driving of the feeding motor 51, the clutch 52, and the transporting motor 18 to feed and transport the medium 14.

Specifically, when the controller 50 drives the feeding motor 51 while the clutch 52 is disengaged, the feeding rollers 31 to 33 rotate but the toothed roller 35 does not rotate. When the controller 50 drives the feeding motor 51 while the clutch 52 is engaged, the feeding rollers 31 to 33 and the toothed roller 35 rotate.

Meanwhile, the feeding rollers 31 to 33 and the toothed roller 35 start their rotation at different times respectively. That is, due to manufacturing errors and other factors, among the printing apparatuses 11 of the same model, some toothed rollers 35 start rotation earlier than the feeding rollers 31 to 33, or some feeding rollers 31 to 33 start rotation earlier than the toothed rollers 35. If the feeding rollers 31 to 33 and the toothed roller 35 start rotation at the same time, a time difference between the time the toothed roller 35 starts rotation and the time the feeding rollers 31 to 33 start rotation is defined as a lag time (for example, several milliseconds (msecs)).

Hereinafter, a feeding process routine to be performed by the controller 50 will be described with reference to the flowchart in FIG. 3. The feeding process routine is executed when print job information is input via an external device (not illustrated), or the like and printing is started. The print job information according to the embodiment includes the selected supply path, which one of one-sided printing and two-sided printing is to be performed, the type and grammage of the medium 14, the coverage rate, and the like.

The grammage is a weight per unit area. The larger the grammage of the medium 14, the thicker the medium 14, and generally, the less flexible the medium 14. On the other hand, the smaller the grammage of the medium 14, the thinner the medium 14, and generally, the more flexible the medium 14. The coverage rate is the ratio of the area to be printed with respect to the unit area in the medium 14. The higher the coverage rate, the more liquid is to be applied. If the medium 14 is cellulose-based paper, when printing is performed onto the medium 14 with a water-based ink, the ink weakens the hydrogen bonds of the cellulose. As a result, even if the medium 14 is a less flexible medium, the medium 14 may become more flexible as the coverage rate increases.

Figure 3:
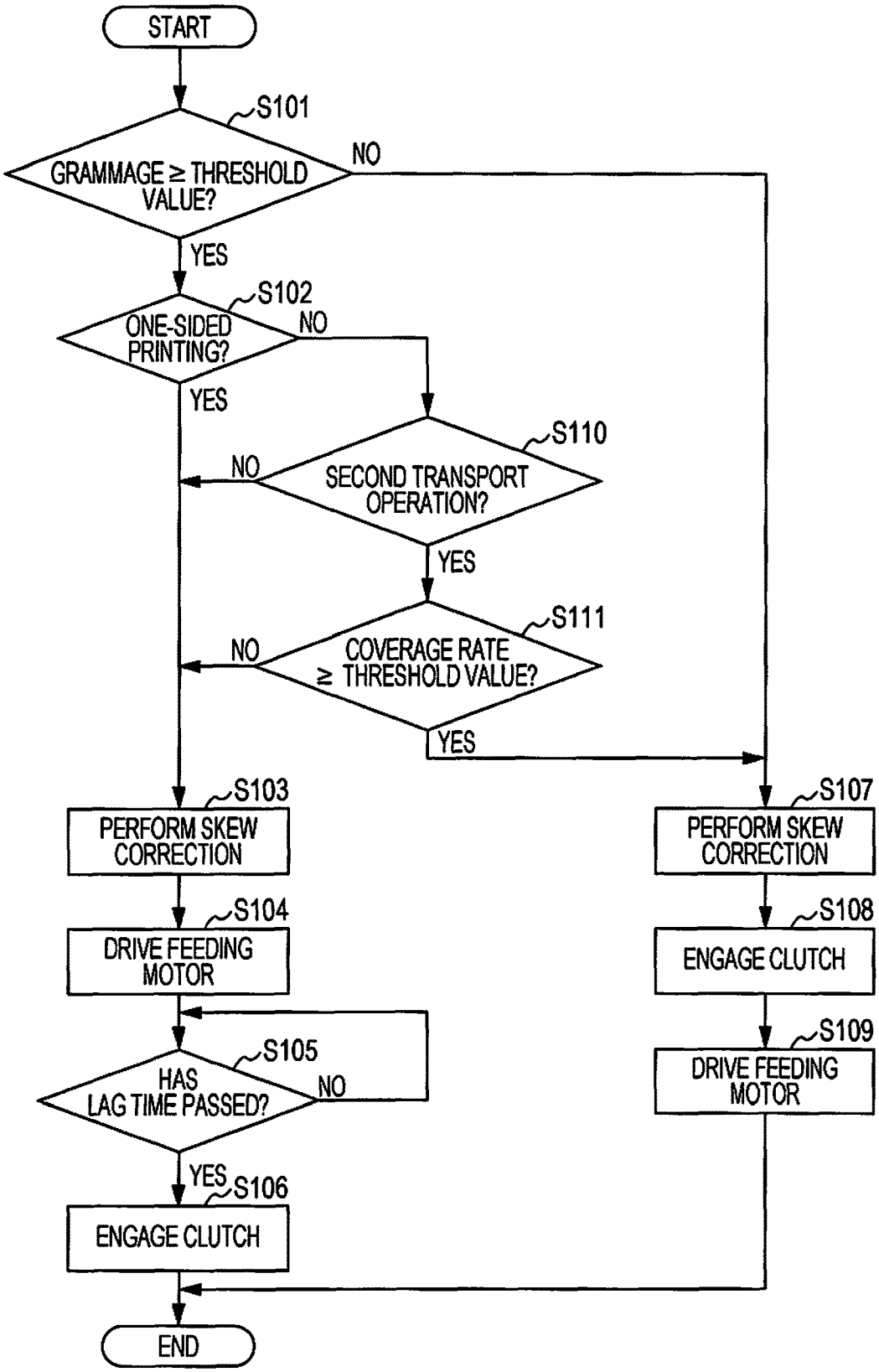
FIG. 3 is a flowchart of a feeding processing routine.

As illustrated in FIG. 3, in step S101, the controller 50 determines based on print job information whether the grammage of the medium 14 is greater than or equal to a threshold value (for example, 90 g/m$^2$). If the grammage of the medium 14 is greater than or equal to the threshold value, that is, the medium 14 is a thick medium (YES in step S101), in step S102, the controller 50 determines which one of two-sided printing and one-sided printing is to be performed.

If one-sided printing is to be performed (YES in step S102), in step S103, the controller 50 performs skew correction for correcting skewing of the fed medium 14. Specifically, when the controller 50 drives the feeding motor 51 while the clutch 52 is disengaged, the feeding rollers 31 to 33 are rotated while the toothed roller 35 is stopped. Then, the controller 50 continues to rotate the feeding rollers 31 to 33 after the medium 14 has collided with the toothed roller 35 and temporarily stops driving the feeding motor 51 in a state in which the medium 14 has collided with the toothed roller 35 and has bent.

In step S104, the controller 50 drives the feeding motor 51. At this time, since the clutch 52 is disengaged, the feeding rollers 31 to 33 rotate and the toothed roller 35 continues to stop.

In step S105, the controller 50 determines whether a lag time has passed. If the lag time has not passed (NO in step S105), the controller 50 stands by while driving the feeding motor 51. After the lag time has passed (YES in step S105), in step S106, the controller 50 engages the clutch 52. By this operation, in addition to the feeding rollers 31 to 33, the toothed roller 35 is rotated.

As described above, in step S103 to step S106, prior to the rotation of the toothed roller 35, with which the medium 14 has collided in the state in which the toothed roller 35 is stopped for skew correction for rotation control of the thick medium, the controller 50 performs rotation control by rotating the feeding rollers 31 to 33. It should be noted that the controller 50 performs the rotation control for a thick medium if the grammage of the medium 14 is greater than or equal to the threshold value.

In step S101, if the medium 14 is a thin medium, that is, the grammage of the medium 14 is less than the threshold value (NO in step S101), in step S107, the controller 50 performs skew correction similarly in step S103.

In step S108, the controller 50 connects the clutch 52, and in step S109, drives the feeding motor 51. In other words, the controller 50 transmits the driving force to the feeding rollers 31 to 33 and the toothed roller 35 at substantially the same time to rotate the feeding rollers 31 to 33 and the toothed roller 35.

As described above, in step S107 to step S109, for rotation control for a thin medium, the controller 50 performs the rotation control by rotating the toothed roller 35, with which the medium 14 has collided in the state in which the toothed roller 35 is stopped for skew correction, and the feeding rollers 31 to 33 at substantially the same time.

In step S102, if two-sided printing is to be performed (NO in step S102), in step S110, the controller 50 determines whether the transport operation is a first transport operation in which the front side 14*a* is placed on the printing unit 17 side or a second transport operation in which the back side 14*b* is placed on the printing unit 17 side.

In step S110, if the transport operation is the first transport operation (NO in step S110), the controller 50 proceeds to the processing in step S103, and performs the rotation control for a thick medium. If the transport operation is the second transport operation (YES in step S110), in step S111, the controller 50 determines whether the coverage rate is greater than or equal to a threshold value (for example, 50%).

If the coverage rate is greater than or equal to the threshold value (YES in step S111), the controller 50 proceeds to the processing in step S107 and performs the rotation control for a thin medium. If the coverage rate is less than the threshold value (NO in step S111), the controller 50 proceeds to the processing in step S103 and performs the rotation control for a thick medium.

Next, operations for supplying a medium 14 that is thick and that has a grammage greater than or equal to a threshold value from the insertion slot 12*b* and performing one-sided printing onto the medium 14 during printing by using the printing apparatus 11 will be described.

Figure 4:
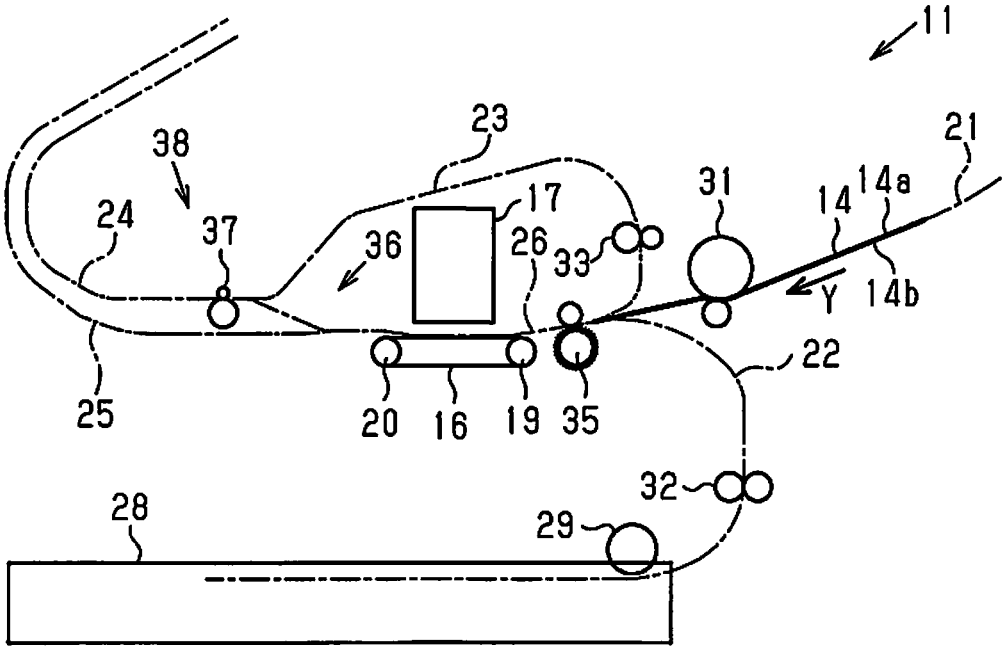
FIG. 4 is a schematic view of a printing apparatus that feeds a medium along a first supply path.

As illustrated in FIG. 4, the controller 50 drives the feeding motor 51 to rotate the feeding rollers 31 to 33 while the clutch 52 is disengaged. By this rotation, the medium 14 is fed by the first feeding roller 31 along the first supply path 21 and collides with the toothed roller 35.

Figure 5:
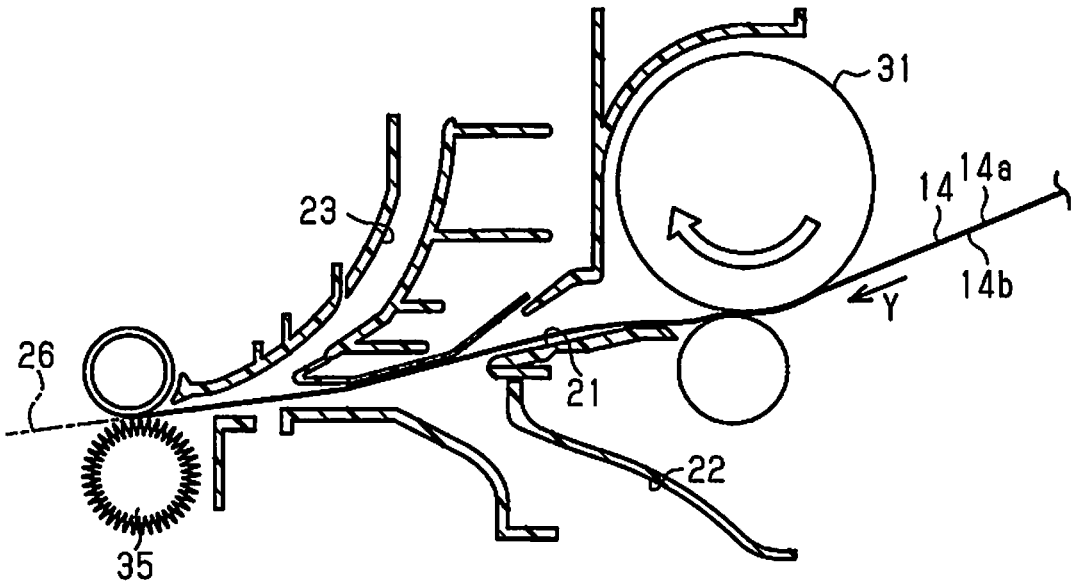
FIG. 5 is a schematic view of a toothed roller and a first feeding roller that correct skewing of a thick medium.

As illustrated in FIG. 5, after the medium 14 has collided with the toothed roller 35, the controller 50 continues to rotate the first feeding roller 31. By this operation, the medium 14 bends and the leading edge (the downstream end in the transport direction Y) of the medium 14 fits along the toothed roller 35, and thereby skewing of the medium 14 is corrected (skew correction is performed). After the correction, the controller 50 stops driving of the feeding motor 51 to temporarily stop the rotation of the feeding rollers 31 to 33.

Then, the controller 50 drives the feeding motor 51 while the clutch 52 is disengaged to resume the rotation of the feeding rollers 31 to 33. After the lag time has passed, the controller 50 engages the clutch 52 to also rotate the toothed roller 35. That is, the feeding rollers 31 to 33 are driven and then the toothed roller 35 is driven. In other words, at the time the toothed roller 35 starts rotating, the feeding rollers 31 to 33 have already been rotating. Accordingly, when the rotation of the toothed roller 35 is started, the medium 14 is transported in a state in which slipping with respect to the medium 14 is suppressed. The medium 14 is transported to the printing unit 17 and a print operation is performed on the medium 14 when the medium 14 passes through the printing unit 17. The medium 14 is transported along the discharge path 25 and discharged from the discharge port 39.

Operations for supplying a medium 14 that is thin and that has a grammage less than the threshold value from the insertion slot 12*b* and performing one-sided printing will be described. The operations for temporarily stopping the rotation of the feeding rollers 31 to 33 while the medium 14 collides with the toothed roller 35 are similar regardless of the grammage of the medium 14, and the description of the operations is omitted.

Figure 6:
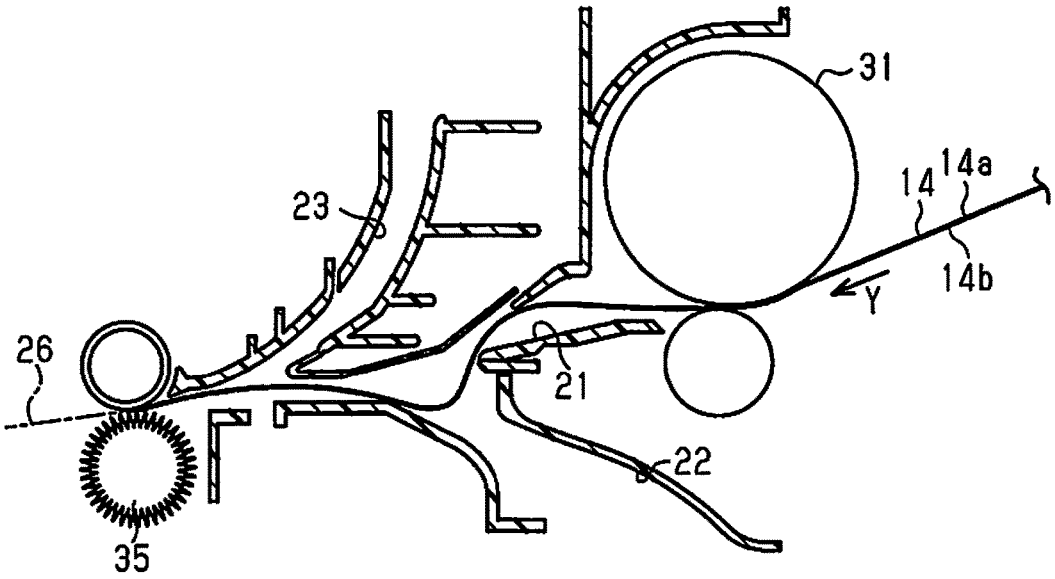
FIG. 6 is a schematic view of the toothed roller and the first feeding roller that correct skewing of a thin medium.

As illustrated in FIG. 6, the medium 14 that has a small grammage bends easier than the medium 14 that has a large grammage. Consequently, the smaller the grammage, the more the medium 14 that has collided with the toothed roller 35 bends. The controller 50 drives the feeding motor 51 to rotate the feeding rollers 31 to 33 and the toothed roller 35 while the clutch 52 is engaged.

Although the feeding rollers 31 to 33 and the toothed roller 35 have been instructed to rotate at the same time, the individual rollers may start to rotate at different times. Accordingly, for example, if there is a delay in starting rotation of the toothed roller 35, and the feeding rollers 31, 32, or 33 have started to rotate before the toothed roller 35 starts to rotate, the medium 14 slightly greatly bends and is transported by the toothed roller 35 that has just started to rotate.

Figure 7:
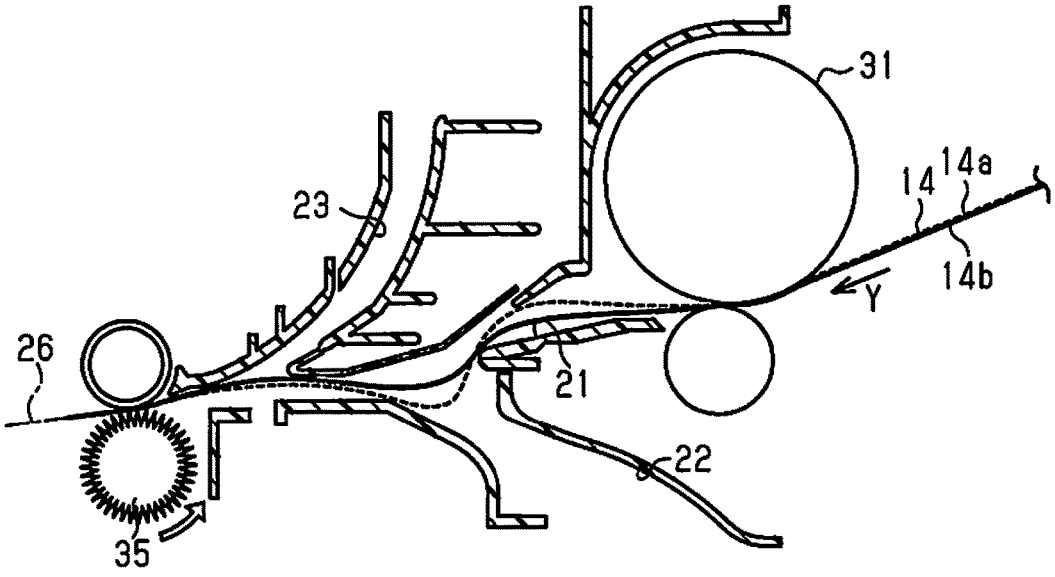
FIG. 7 is a schematic view of the toothed roller that is rotated after skew correction has been performed.

In another case, as illustrated in FIG. 7, if the toothed roller 35 starts to rotate before the feeding rollers 31, 32, or 33 start to rotate, at the time the toothed roller 35 starts to rotate, the medium 14 is being held by the feeding rollers 31, 32, or 33 that are stopped. Accordingly, the medium 14 is transported such that bending of the medium 14 is suppressed by the toothed roller 35, and the medium 14 is transported by the feeding rollers 31, 32, or 33 that start to rotate after a delay.

Next, operations for supplying a medium 14 that is thick and the has a grammage greater than or equal to the threshold value from the medium cassette 28 and performing two-sided printing will be described. It is assumed that printing is performed onto the front side 14*a* of the medium 14 at a coverage rate greater than or equal to the threshold value.

Figure 8:
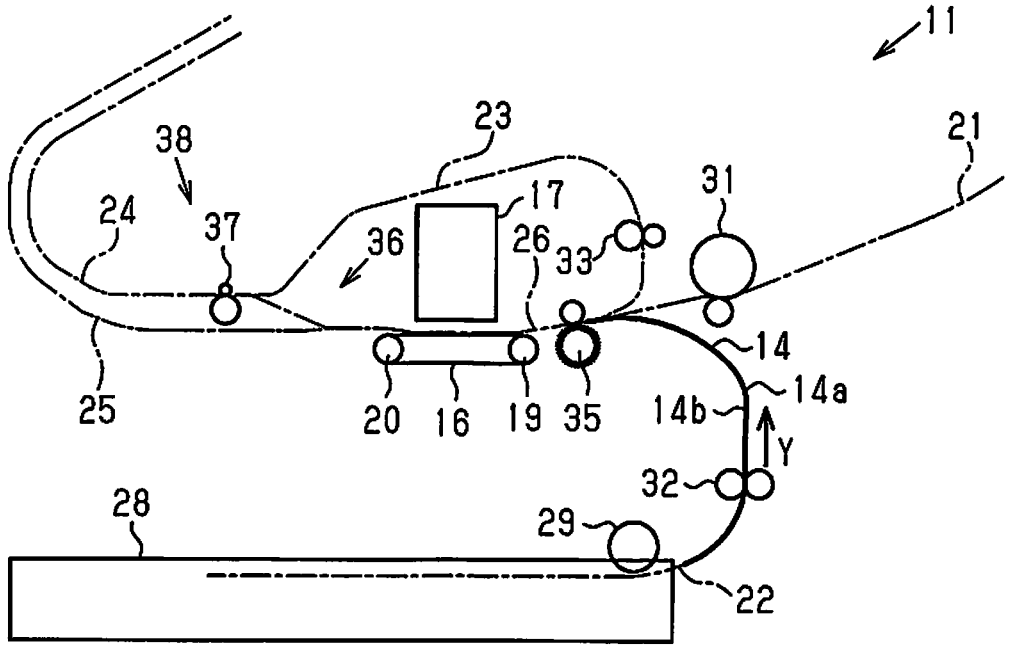
FIG. 8 is a schematic view of the printing apparatus that performs skew correction on a medium that is fed on a second supply path.

As illustrated in FIG. 8, the controller 50 drives the pickup roller 29 to supply the medium 14 from the medium cassette 28, performs skew correction, and stops the feeding motor 51. Then, the controller 50 drives the feeding motor 51 while the clutch 52 is disengaged to resume the rotation of the feeding rollers 31 to 33. After the lag time has passed, the controller 50 engages the clutch 52 to rotate the toothed roller 35, and thereby the medium 14 is transported toward the printing unit 17. That is, the controller 50 performs rotation control for a thick medium during the first transport operation, in which the front side 14*a* is placed on the printing unit 17 side. The printing unit 17 discharges a liquid such as an ink to perform printing on the front side 14*a* of the medium 14 at a coverage rate greater than or equal to the threshold value when the medium 14 passes through the printing unit 17.

Figure 9:
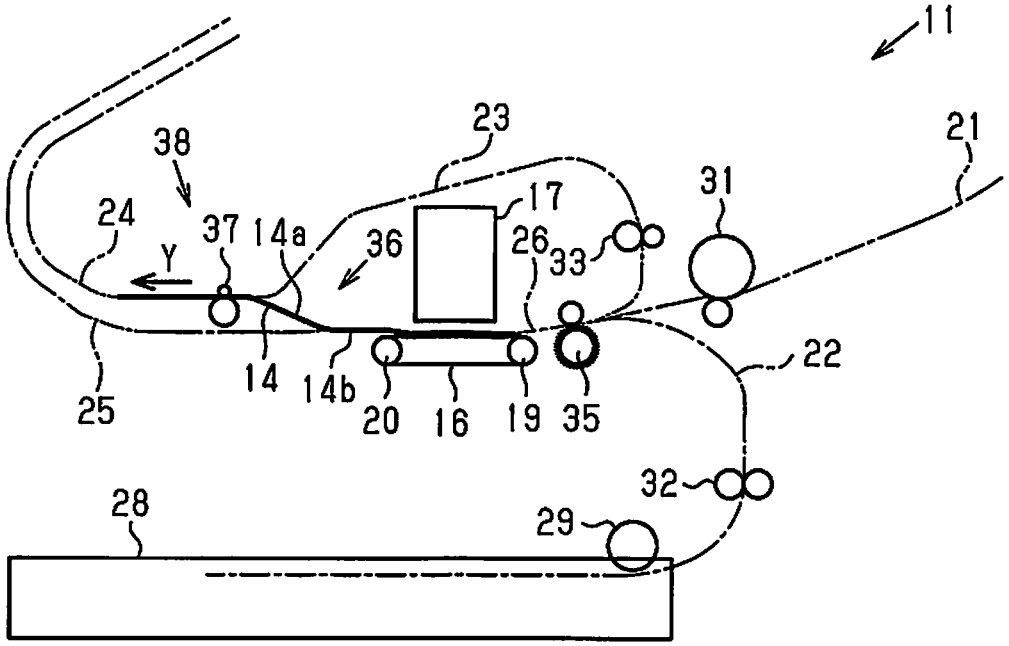
FIG. 9 is a schematic view of the printing apparatus that switches back the medium on which printing has been performed on the front side.

As illustrated in FIG. 9, the medium 14, on which printing has been performed on the front side 14*a* by the printing unit 17, is guided toward the branch path 24 by the branching mechanism 36.

Figure 10:
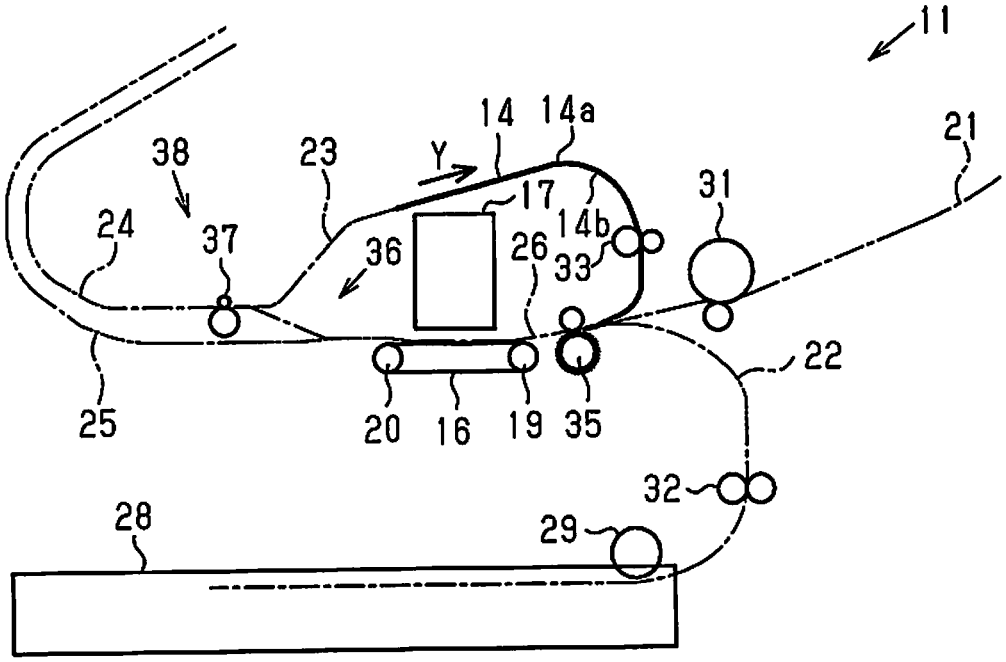
FIG. 10 is a schematic view of a printing apparatus that performs skew correction on the medium that is fed on a third supply path.

As illustrated in FIG. 10, the branch roller pair 37 is reversely driven to reversely transport the medium 14, which has been held on the branch path 24, along the branch path 24, and the medium 14 is guided by the branching mechanism 36 toward the third supply path 23. As described above, the medium 14 is switched back by the switchback mechanism 38 and transported along the third supply path 23, and the leading edge of the medium 14 collides with the toothed roller 35 and skew correction is performed accordingly.

Figure 11:
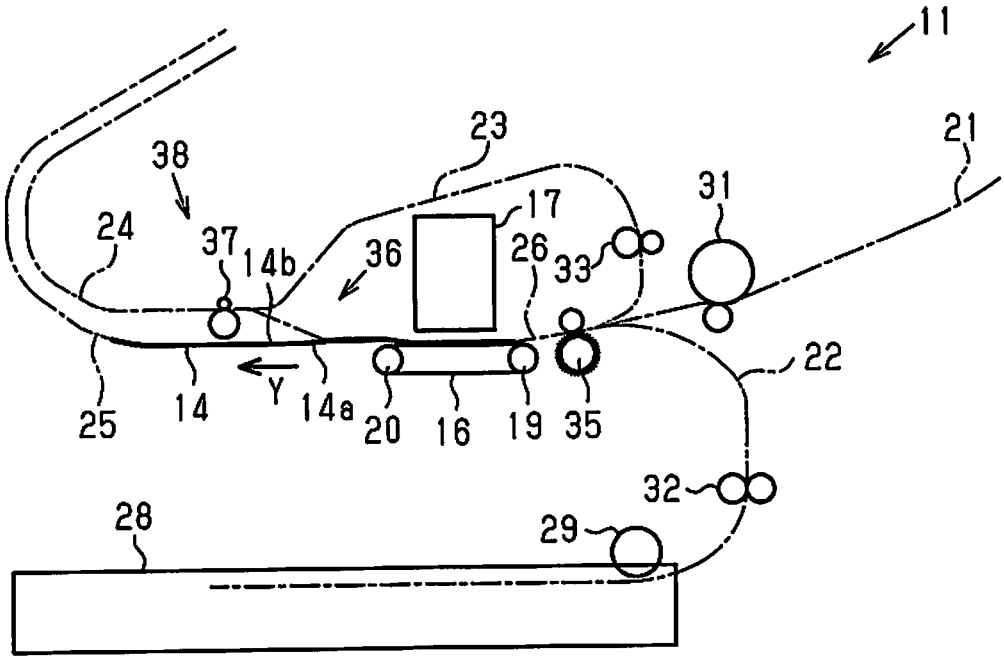
FIG. 11 is a schematic view of the printing apparatus that transports the medium on which printing has been performed on the back side along a discharge path.

As illustrated in FIG. 11, after skew correction, the controller 50 drives the feeding motor 51 to rotate the feeding rollers 31 to 33 and the toothed roller 35 while the clutch 52 is engaged, and thereby the medium 14 is transported toward the printing unit 17. That is, the controller 50 performs the rotation control for a thin medium in the second transport operation, in which the medium 14 on which printing has been performed on the front side 14*a* in the first transport operation is switched back by the switchback mechanism 38 and the back side 14*b* of the medium 14 is placed on the printing unit 17 side. The medium 14 is transported to the printing unit 17 and a print operation is performed on the medium 14 when the medium 14 passes through the printing unit 17, and the medium 14 is transported along the discharge path 25 and discharged from the discharge port 39.

According to the above-described embodiment, the following advantages can be achieved.

(1) Rotating the toothed roller 35 may cause slip against the medium 14 and damage the medium 14. To address the problem, the rotation control for a thick medium for rotating the feeding rollers 31 to 33 is performed prior to rotating the toothed roller 35, and the toothed roller 35 can be prevented from slipping against the medium 14 accordingly. As a result, damage to the medium 14 can be reduced compared with the case where the rotation control for a thick medium is not performed.

(2) The medium 14 that has a large grammage is firm and less flexible, whereas the medium 14 that has a small grammage is less firm and less flexible. Accordingly, if the rotation control for a thick medium is performed when the medium 14 having a small grammage is fed, the medium 14 may be largely bent and the medium 14 may buckle. To address the problem, if the grammage of the medium 14 is greater than or equal to a threshold value, the controller 50 performs the rotation control for a thick medium, and thereby the medium 14 can be fed while buckling is reduced.

(3) The feeding rollers 31 to 33 continue to rotate after the medium 14 has collided with the toothed roller 35. This rotation causes the medium 14 to bend, which enables the medium 14 to correct its skewing. Accordingly, for example, even if the medium 14 is supplied in a skewed state, the medium 14 can be corrected and fed.

(4) For example, if the medium 14 is cellulose-based paper, when printing is performed onto the medium 14 with a water-based ink, the ink weakens the hydrogen bonds of the cellulose and the medium 14 becomes more flexible. Consequently, the medium 14 is easier to bend during the second transport operation, in which printing has been performed on the front side 14*a* and the medium 14 is switched back, than the medium 14 during the first transport operation, in which printing has not been performed on the medium 14. To address the problem, the rotation control for a thick medium is performed during the first transport operation, in which the medium 14 is less flexible, to reduce damage to the medium 14.

(5) Transmission and interruption of driving force to the toothed roller 35 can be switched by the clutch 52, and the feeding rollers 31 to 33 and the toothed roller 35 can be rotated by one feeding motor 51.

(6) When the medium 14 collides with the stopped toothed roller 35, the medium 14 bends. Accordingly, for example, when the toothed roller 35 is rotated prior to rotating the feeding rollers 31 to 33, the medium 14 is transported such that bending of the medium 14 is reduced. However, if skew correction is similarly performed on the media 14 that have different grammages, the medium 14 that has a larger grammage bends less than the medium 14 that has a smaller grammage. Consequently, if the toothed roller 35 is rotated while the feeding rollers 31 to 33 are nipping the medium 14 without being rotated, bending of the medium 14 having the smaller grammage is eliminated in a short time and the toothed roller 35 slips with respect to the medium 14. Accordingly, the medium 14 that has the larger grammage is damaged more easily than the medium 14 that has the smaller grammage. To address the problem, if the grammage of the medium 14 is greater than or equal to a threshold value, the controller 50 performs the rotation control for a thick medium, and thereby the medium 14 can be fed while buckling is reduced.

(7) Stopping the feeding rollers 31 to 33 after skew correction enables the printing apparatus 11 to more easily control the movement of the medium 14 compared to a case where rotation of the toothed roller 35 is started while the feeding rollers 31 to 33 are rotated. Consequently, the accuracy in the skew correction can be increased.

The above-described embodiment can be modified as described below.

Figure 12:
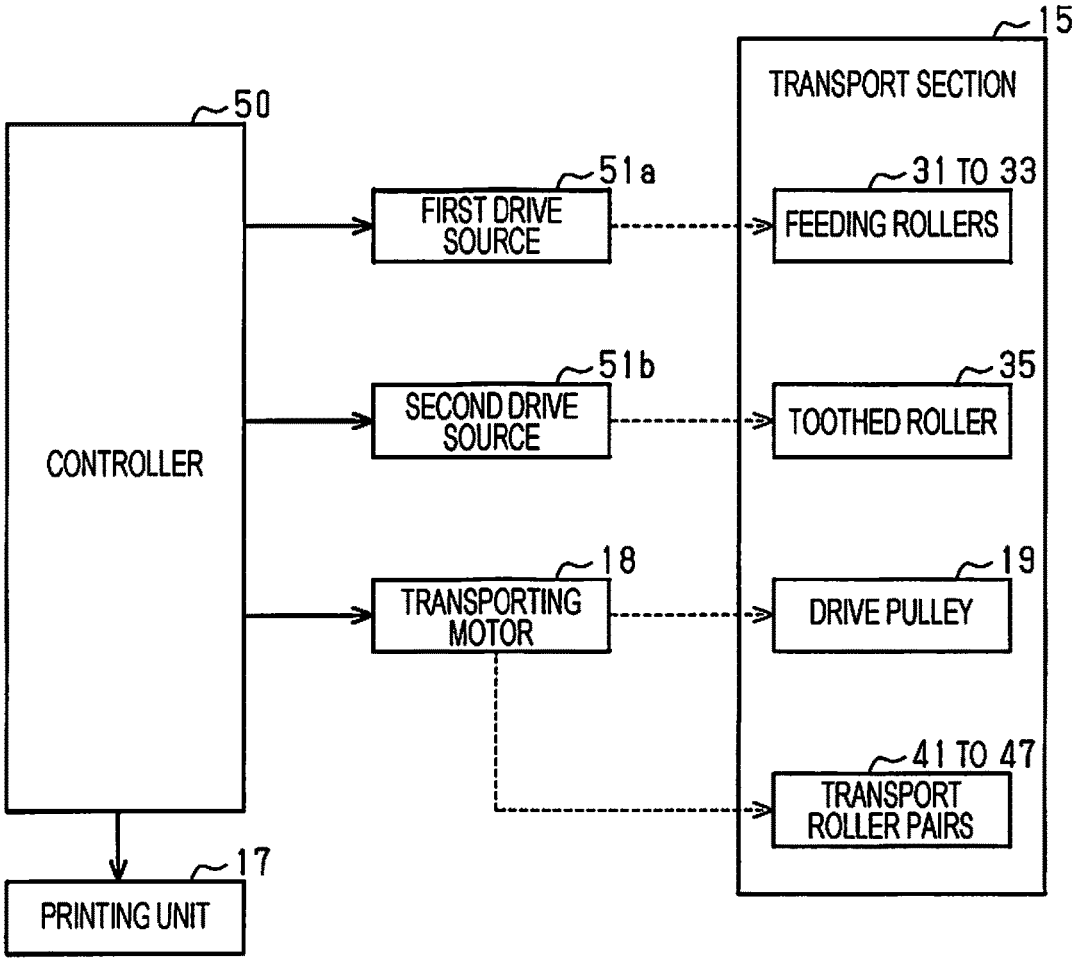
FIG. 12 is a block diagram of a controller according to a first modification.

As illustrated in FIG. 12, the drive source that rotates the feeding rollers 31 to 33 and the toothed roller 35 may include a first drive source 51*a* that rotates the feeding rollers 31 to 33 and a second drive source 51*b* that rotates the toothed roller 35 (first modification). That is, the feeding rollers 31 to 33 and the toothed roller 35 may be rotated by different drive sources. In such a case, the controller 50 drives the first drive source 51*a* to rotate the feeding rollers 31 to 33 when driving the feeding motor 51 in the above-described embodiment. The controller 50 drives the second drive source 51*b* to rotate the toothed roller 35 when engaging the clutch 52 or driving the feeding motor 51 while the clutch 52 is engaged in the above-described embodiment.

According to the first modification, the controller 50 drives the first drive source 51*a* to rotate the feeding rollers 31 to 33 and drives the second drive source 51*b* to rotate the toothed roller 35, which enables the controller 50 to readily control the rotation of the feeding rollers 31 to 33 and the toothed roller 35.

In the above-described embodiment, a plurality of threshold values of grammage of the medium 14 may be provided. Furthermore, in accordance with a grammage of the medium 14, a supply path may be selected. For example, for a medium 14 that is thick and that has a grammage of, for example, 160 g/m$^2$ or more, such as a large square card or thick paper, it may be determined that the medium 14 is supplied from the insertion slot 12*b* along the first supply path 21. For a medium 14 that is thin and that has a grammage of, for example, less than 90 g/m2, such as copy paper, it may be determined that the medium 14 is supplied along the second supply path 22. Furthermore, the controller 50 may perform the rotation control for a thick medium when a medium 14 is supplied from the insertion slot 12*b* along the first supply path 21 (second modification).

According to the second modification, the medium 14 that is supplied along the second supply path 22 is supplied while bending to fit the curve of the second supply path 22.

Consequently, for a less flexible medium 14, the first supply path 21, which is straighter than the second supply path 22, is supplied. Consequently, when supplying the first supply path 21 for the medium 14, the controller 50 performs the rotation control for a thick medium, and thereby damage to the less flexible the medium 14 can be reduced.

In the above-described embodiment, in the rotation control for a thick medium, the controller 50 may change the rotation speed of the feeding rollers 31 to 33 before and after engaging the clutch 52. In other words, by making the rotation speed before engaging the clutch 52 slower than that after engaging the clutch 52, the transport amount of the medium 14 in the lag time can be reduced and the chance of buckling of the medium 14 can be reduced.

In the above-described embodiment, the feeding rollers 31 to 33 and the toothed roller 35 start rotation at different times respectively. Accordingly, for example, in a printing apparatus in which the toothed roller 35 starts to rotate first and the feeding rollers 31 to 33 start to rotate after a lag time has passed, if the rotation control for a thick medium is performed, the feeding rollers 31 to 33 and the toothed roller 35 may simultaneously start to rotate.

In the above-described embodiment, the printing apparatus 11 may include a detector for detecting the thickness of the medium 14, such as an ultrasonic sensor and a contact sensor. The controller 50 may perform the rotation control for a thick medium if the thickness is greater than or equal to a threshold value.

In the above-described embodiment, the controller 50 may engage the clutch 52 without stopping the feeding motor 51 after skew correction. In other words, the controller 50 may rotate the toothed roller 35 without temporarily stopping the feeding rollers 31 to 33.

In the above-described embodiment, the controller 50 may perform the rotation control of the medium 14 in the second transport operation regardless of the coverage rate in the front side 14*a* of the medium 14. For example, the controller 50 may rotate the feeding rollers 31 to 33 before rotating the toothed roller 35 even if the coverage rate is greater than or equal to the threshold value.

In the above-described embodiment, the printing apparatus 11 may omit the switchback mechanism 38 and the third supply path 23. Furthermore, the printing apparatus 11 may omit one of the first supply path 21 and the second supply path 22.

In the above-described embodiment, in rotation control, the controller 50 may stop the rotation of the feeding rollers 31 to 33 when the medium 14 collides with the toothed roller 35. In other words, the controller 50 may not cause the medium 14 to bend and may not perform skew correction.

In the above-described embodiment, the medium 14 that has been supplied from the insertion slot 12*b* along the first supply path 21 may be switched back and two-sided printing may be performed.

In the above-described embodiment, the controller 50 may perform rotation control regardless of the grammage of the medium 14. For example, the controller 50 may perform rotation control in accordance with the type of the medium 14. In other words, in a case of the medium 14 that is less flexible, such as postcards and drawing paper, the controller 50 may perform the rotation control for a thick medium, and in a case of the medium 14 that is flexible, such as copy paper and manuscript paper, the controller 50 may perform the rotation control for a thin medium. The medium 14 may be any material, for example, paper sheets, resin films, resin sheets, composite films of paper and resin (resin impregnated paper, resin coated paper, and the like), metal foils, metal plates, metal films, composite films of resin and metal (laminate films), fabrics, nonwoven fabrics, ceramic sheets, discs, and the like.

In the above-described embodiment, the printing apparatus 11 may be a fluid ejection apparatus that ejects or discharges a fluid (for example, a liquid, a liquid material containing particles of a functional material dispersed or mixed in a liquid, a fluid material such as a gel, and a solid that can be ejected as a fluid) other than inks for recording. For example, the printing apparatus 11 may be a liquid material ejecting apparatus that ejects a liquid material containing a dispersed or dissolved material such as an electrode material or a color material (pixel material) used for manufacturing liquid crystal displays, electroluminescence (EL) displays, or field emission displays (FEDs) for recording. The printing apparatus 11 may be a fluid material ejecting apparatus that ejects a fluid material such as a gel (for example, a physical gel), or a powder and granular material ejecting apparatus (for example, a toner jet type recording apparatus) that ejects a solid, for example a powder (powder and granular material) such as a toner. The present invention can be applied to any one of the fluid ejecting apparatuses. In this specification, "fluid" implies a concept that does not include fluids that consist of only gas, and the fluid includes, for example, liquids (including inorganic solvents, organic solvents, solutions, liquid resins, liquid metals (metallic melts), and the like), liquid materials, fluid materials, and powder and granular materials (including grains and powders).

The entire disclosure of Japanese Patent Application No. 2016-075304, filed Apr. 4, 2016 is expressly incorporated by reference herein.

What is claimed is:

1. A printing apparatus comprising:

a print section configured to perform printing on a first side of a medium and then perform printing on a second side that is a back side of the first side;

a supply path configured to supply the medium toward the print section;

a feeding roller configured to feed the medium along the supply path from an upstream side to a downstream side in a transport direction;

a toothed roller provided on the downstream side of the feeding roller in the transport direction;

a drive source configured to rotate the feeding roller and the toothed roller; and a controller configured to control driving of the drive source, wherein the controller performs rotation control for rotating the feed roller prior to the rotation of the toothed roller with which the medium has collided, and the controller performs the rotation control when the controller determines that the grammage of the medium is greater than or equal to a threshold value.

2. The printing apparatus according to claim 1, wherein the supply path includes:

a first supply path configured to supply the medium from a first supply section toward the print section; and a second supply path configured to supply the medium from a second supply section toward the print section, the second supply path being curved more than the first supply path, and the controller performs the rotation control when the medium is supplied from the first supply section along the first supply path.

3. The printing apparatus according to claim 1, wherein the controller continues to rotate the feeding roller after the medium has collided with the toothed roller in the rotation control.

4. The printing apparatus according to claim 1, further comprising:

a switchback mechanism configured to switch back the medium having the first side and the second side on which printing has been performed on the first side and to transport the medium to the supply path, wherein, between a first transport operation in which the first side is on the print section side and a second transport operation in which the medium is switched back by the switchback mechanism and the second side is on the print section side, the controller performs the rotation control in the first transport operation.

5. The printing apparatus according to claim 1, further comprising:

a clutch capable of interrupting the transmission of the driving force from the drive source to the toothed roller.

6. The printing apparatus according to claim 1, wherein the drive source includes:

a first drive source configured to rotate the feeding roller; and a second drive source configured to rotate the toothed roller.

7. The printing apparatus according to claim 1, wherein the supply path is one of a plurality of supply paths including more than two supply paths, and the toothed roller is located at a position where the plurality of supply paths join together.

* * * * *